US010988945B2

(12) United States Patent
Amato et al.

(10) Patent No.: US 10,988,945 B2
(45) Date of Patent: Apr. 27, 2021

(54) MASONRY FORM SYSTEM AND METHOD OF USING SAME

(71) Applicant: Reform Masonry Products, LLC, Havelock, NC (US)

(72) Inventors: Francis Amato, New Bern, NC (US); Frank Amato, Newport, NC (US)

(73) Assignee: REFORM MASONRY PRODUCTS, LLC, Havelock, NC (US)

( * ) Notice: Subject to any disclaimer, the term of this patent is extended or adjusted under 35 U.S.C. 154(b) by 0 days.

(21) Appl. No.: 16/503,975

(22) Filed: Jul. 5, 2019

(65) Prior Publication Data

US 2020/0018081 A1 Jan. 16, 2020

Related U.S. Application Data

(60) Provisional application No. 62/697,604, filed on Jul. 13, 2018.

(51) Int. Cl.

| | |
|---|---|
| ***E04G 9/05*** | (2006.01) |
| ***E04G 9/10*** | (2006.01) |
| ***E04G 11/08*** | (2006.01) |
| ***E04G 17/02*** | (2006.01) |
| ***E04G 17/12*** | (2006.01) |

(Continued)

(52) U.S. Cl.

CPC ..... *E04G 9/05* (2013.01); *E04G 11/08* (2013.01); *E04G 17/12* (2013.01); *E04G 17/14* (2013.01); *E04G 2009/028* (2013.01)

(58) Field of Classification Search

CPC .... E04G 9/02; E04G 9/05; E04G 9/10; E04G 11/087; E04G 2009/028; E04G 2017/0646; E04G 17/0642; E04G 17/064; E04G 17/12; E04G 11/08; E04G 17/02

USPC ..... 264/31, 33; 249/34, 47, 192, 189, 193, 249/194, 44, 2, 3, 4, 5, 6, 7; 52/592.3

See application file for complete search history.

(56) References Cited

U.S. PATENT DOCUMENTS 683,081 A * 9/1901 Sullivan ..... E01C 19/504 249/9
945,859 A * 1/1910 Neuberger ..... E04B 2/14 52/592.3

(Continued)

FOREIGN PATENT DOCUMENTS

DE 3129838 A1 * 2/1983 ..... E04G 9/04
DE 202012006295 U1 * 2/2014 ..... E04G 9/05

(Continued)

*Primary Examiner* — Michael Safavi
(74) *Attorney, Agent, or Firm* — Ward and Smith, P.A.; Ryan K. Simmons

(57) ABSTRACT

A masonry form system including a plurality of masonry form members, wherein the plurality of masonry form members may include opposing vertical side walls; and a connector mechanism on at least one end of each of the plurality of masonry form members; and wherein, the plurality of masonry form members may be configured to be connected together via the connector mechanisms. A method of using a masonry form system including providing a masonry form system, selecting and positioning the selected plurality of masonry form members based on a pre-determined plan to form a desired masonry form; and connecting the selected and positioned plurality of masonry form members together.

22 Claims, 15 Drawing Sheets

(51) Int. Cl.
*E04G 17/14* (2006.01)
*E04G 9/02* (2006.01)

(56) References Cited

U.S. PATENT DOCUMENTS 1,564,982 A * 12/1925 Smith ..... E04G 17/12 249/215
RE16,793 E * 11/1927 Smith ..... E04G 17/12 249/215
1,722,682 A * 7/1929 Rota ..... E04B 2/14 52/503
3,381,929 A * 5/1968 Bancker ..... E04G 9/02 249/5
3,429,547 A * 2/1969 Schimmel ..... E04G 11/10 249/192
3,825,220 A * 7/1974 Schmaltz ..... E04G 11/10 249/194
3,910,546 A * 10/1975 Connors ..... E04G 17/0721 249/40
3,969,852 A * 7/1976 Krings ..... E02D 17/08 52/155
4,192,215 A * 3/1980 Hymans ..... E04C 5/122 24/122.6
4,548,005 A * 10/1985 Glonek ..... E04H 4/0043 248/156
4,678,156 A * 7/1987 Scalamandre ..... E04G 17/06 249/191
4,832,308 A * 5/1989 Slonimsky ..... E04G 9/02 249/189
4,889,310 A * 12/1989 Boeshart ..... E04B 2/8641 249/41
5,535,565 A * 7/1996 Majnaric ..... E04C 3/28 249/192
5,735,090 A * 4/1998 Papke ..... E02D 27/00 52/220.2
5,833,872 A * 11/1998 De Le fevre ..... E04G 9/02 249/34
5,861,105 A * 1/1999 Martineau ..... E04B 2/8652 249/190
6,021,994 A * 2/2000 Shartzer, Jr. ..... E01C 19/502 249/189
6,231,025 B1 * 5/2001 Takemura ..... E04G 13/00 249/18
6,742,758 B2 * 6/2004 Janesky ..... E04G 9/05 249/165
6,817,150 B1 * 11/2004 Boeshart ..... B28B 7/0082 249/102
6,832,456 B1 * 12/2004 Bilowol ..... E04G 9/02 52/426
6,918,567 B2 * 7/2005 Ward ..... E04G 13/00 249/189
8,122,668 B2 * 2/2012 Fang ..... E04B 2/16 52/285.2
8,360,389 B2 * 1/2013 Schwoerer ..... E04G 11/087 249/44
9,080,334 B2 * 7/2015 Hayasaki ..... E04G 9/02
10,364,570 B2 * 7/2019 Johnston ..... E04B 2/8629
2003/0084632 A1 * 5/2003 Takagi ..... B28B 7/0014 52/381
2005/0023432 A1 * 2/2005 Huber ..... E04G 21/185 249/34
2006/0180732 A1 * 8/2006 Lawrence ..... B28B 7/02 249/34
2015/0069210 A1 * 3/2015 Park ..... E01C 19/50 249/2
2015/0204085 A1 * 7/2015 Koszo ..... E04B 2/68 52/742.14
2015/0275531 A1 * 10/2015 Alcala Ordaz ..... E04B 2/8658 249/189
2020/0139652 A1 * 5/2020 Collar ..... E04G 5/08

FOREIGN PATENT DOCUMENTS

EP 0448120 * 9/1991 ..... E04G 9/05
EP 1158105 A2 * 11/2001 ..... E02D 13/00
GB 2538553 A * 11/2016 ..... E04G 9/05
JP 6-66021 * 3/1994 ..... E04G 9/05
JP 6-101335 * 4/1994 ..... E04G 9/05
JP 2000-17776 * 1/2000 ..... E04G 2009/028
JP 2000-34834 * 2/2000 ..... E04G 2009/028
KR 2004095001 A * 11/2004 ..... E04G 9/02
WO WO-2005040525 A1 * 5/2005 ..... E04G 17/001
WO WO-2005040526 A1 * 5/2005 ..... E04G 17/001
WO WO-2007024201 A1 * 3/2007 ..... E04G 11/10

* cited by examiner

MASONRY FORM SYSTEM AND METHOD OF USING SAME

CROSS-REFERENCE TO RELATED APPLICATIONS

This application is related and claims priority to U.S. Pat. App. Ser. No. 62/697,604, entitled "Masonry Form System and Method Comprising Plastic Reusable Masonry Form Members," filed on Jul. 13, 2018, the disclosure of which is incorporated herein by reference in its entirety.

FIELD OF THE INVENTION

The presently disclosed subject matter relates generally to forms used in masonry applications and more particularly to a masonry form system and method including plastic reusable masonry form members.

BACKGROUND

In building projects, such as residential homes and commercial buildings, concrete can be used for various structural elements, such as footings, foundations, steps, driveways, posts, pillars, columns, and the like. Generally, a wooden form is constructed for a given element and then concrete is poured into the form. Once the concrete is sufficiently set, the form is removed. In this process, the wooden form may be custom built on site, then the concrete is poured into the form, and then once the concrete is set the wooden form is often removed in a destructive manner and is therefore not reusable. Further, steel forms are also in use today. However, steel forms are heavy and difficult to handle, store, and transport. Accordingly, more efficient and cost-effect approaches are needed with respect to constructing and deconstructing masonry forms.

SUMMARY

In one embodiment, a masonry form system is provided. The masonry form system may include a plurality of masonry form members, wherein the plurality of masonry form members may include opposing vertical side walls; and a connector mechanism on at least one end of each of the plurality of masonry form members; and wherein, the plurality of masonry form members may be configured to be connected together via the connector mechanisms. The masonry form system may further include one or more anti-spread clips, wherein the anti-spread clips may be configured to engage a pair of opposing masonry form members laterally spaced apart from one another, and wherein the anti-spread clip may be configured to span from a top portion of first vertical wall of a first masonry form member to a top portion of a second vertical wall of a second masonry form member. The one or more anti-spread clips may include a cross member; side members, one extending vertically downward from each end of the cross member; and a lip extending horizontally inward from each of the side members. The plurality of masonry form members may include one or more of any of a straight member, a spacer member, a corner member, and/or a U-shaped member. The plurality of masonry form members may be configurable to provide a masonry form for building footings in a residential or commercial application. The plurality of masonry form members may be configurable to form a first outer perimeter structure and a second inner perimeter structure, wherein the first outer perimeter structure and the second inner perimeter structure are spaced apart and configured to receive concrete to form footings. The plurality of masonry form members may include thermoplastic material. The plurality of masonry form members may be at least partially hollow between the opposing vertical side walls. The one or more of the plurality of masonry form members may be at least partially filled with a structural foam between the opposing vertical side walls. The plurality of masonry form members may include one or more vertical ribs formed between the opposing vertical side walls. The plurality of masonry form members may include one or more horizontal ribs formed between the opposing vertical side walls. The plurality of masonry form members may include one or more horizontal ribs and one or more horizontal ribs formed between the opposing vertical side walls. The plurality of masonry form members may include one or more channels extending vertically through one or more of the plurality of masonry form members. The connector mechanism may include either of a connector tab or a connector slot. The connector tab of a first masonry form member may be configured to slideable engage with the connector slot of an adjacent second masonry form member. The one or more of the plurality of masonry form members may include the connector tab on one end and the connector slot on an opposing end. The one or more of the plurality of masonry form members each may include a connector tab on both ends or a connector slot on both ends. The corner member may be configured to form a substantially 90 degree corner. The masonry form system may include one or more horizontal ribs extending along an exterior surface of one or both of the opposing vertical side walls.

In another embodiment, a method of using a masonry form system is provided. The method may include providing a masonry form system. The masonry form system may include a plurality of masonry form members, wherein the plurality of masonry form members may include opposing vertical side walls; and a connector mechanism on at least one end of each of the plurality of masonry form members; and wherein, the plurality of masonry form members may be configured to be connected together via the connector mechanisms. The method may further include selecting and positioning the selected plurality of masonry form members based on a pre-determined plan to form a desired masonry form; and connecting the selected and positioned plurality of masonry form members together. The method may further include pouring concrete into the formed masonry form. The method may further include securing one or more of the plurality of masonry form members in place via driving rebar vertically through one or more vertical channels formed in the one or more of the plurality of masonry form members, and into the ground. The method may further include installing one or more anti-spread clips across a top portion of two opposing masonry form members spaced laterally apart from one another. The method may further include disassembling the connected plurality of masonry form members.

BRIEF DESCRIPTION OF THE DRAWINGS

Figure 1:
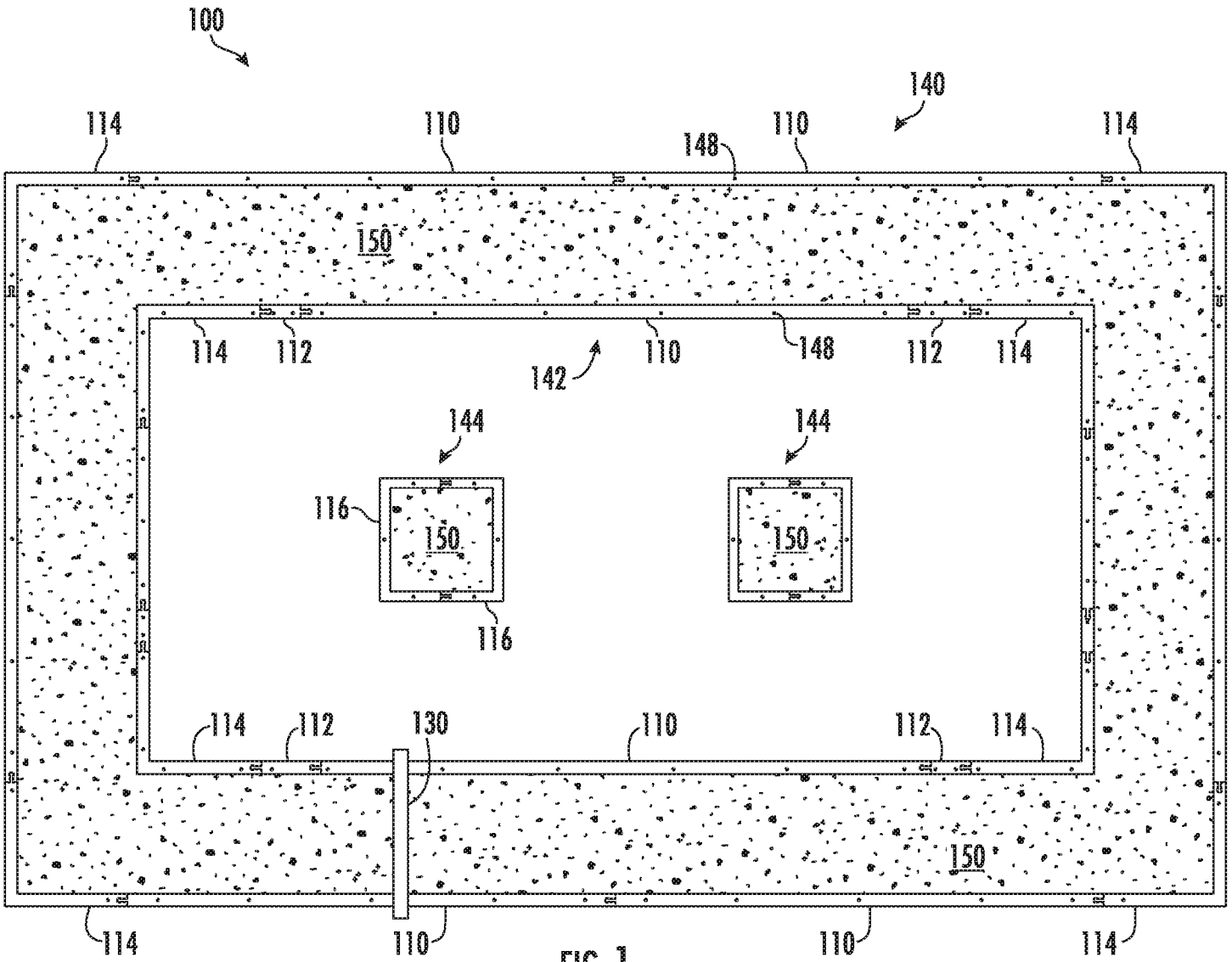
Figure 2:
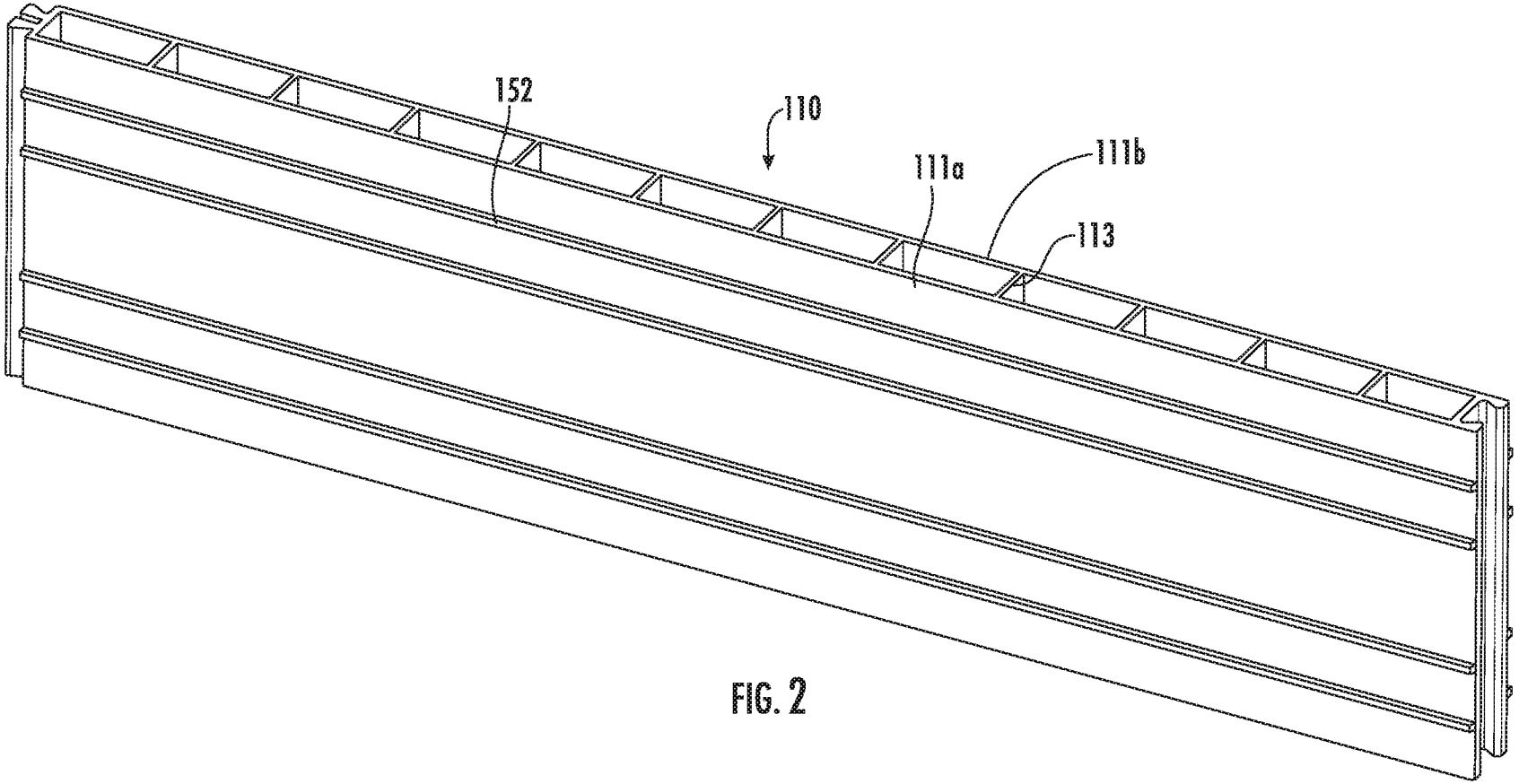
Figure 3:
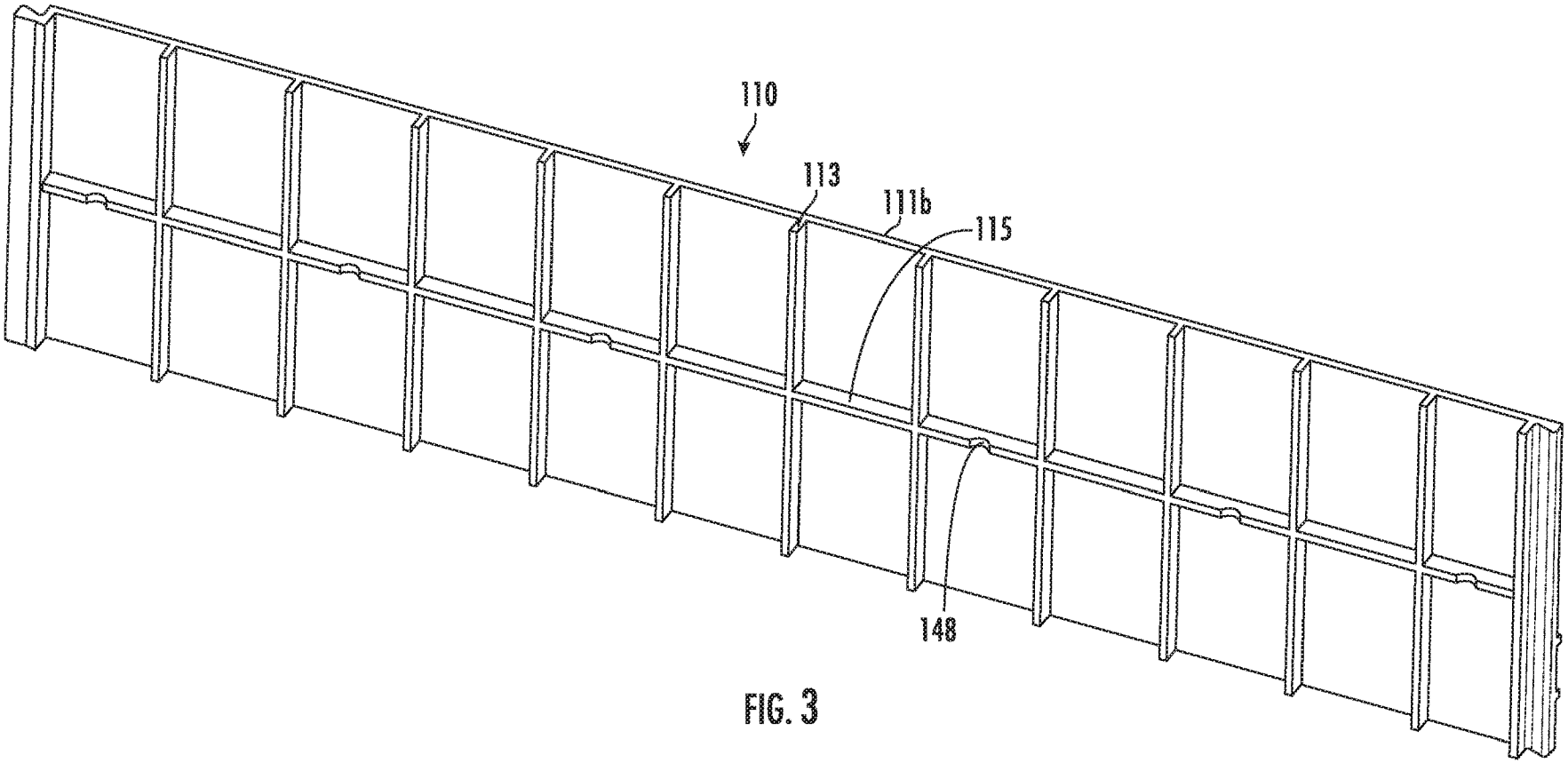
Figure 4:
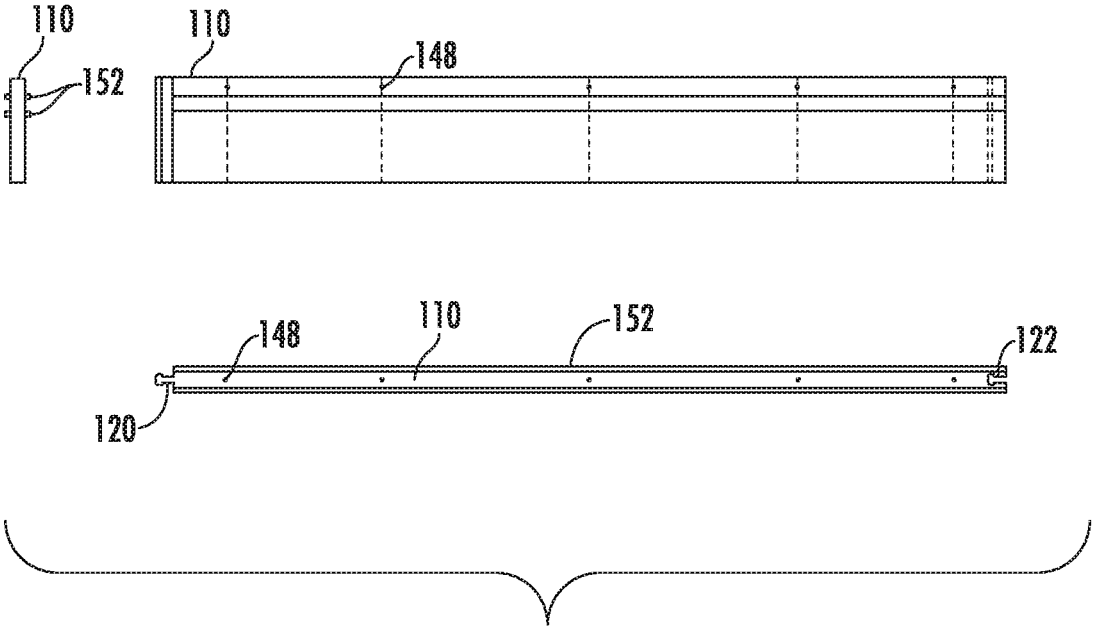
Figure 5:
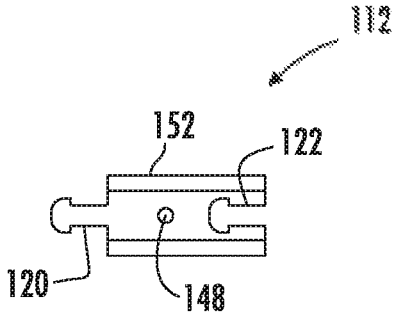
Figure 6:
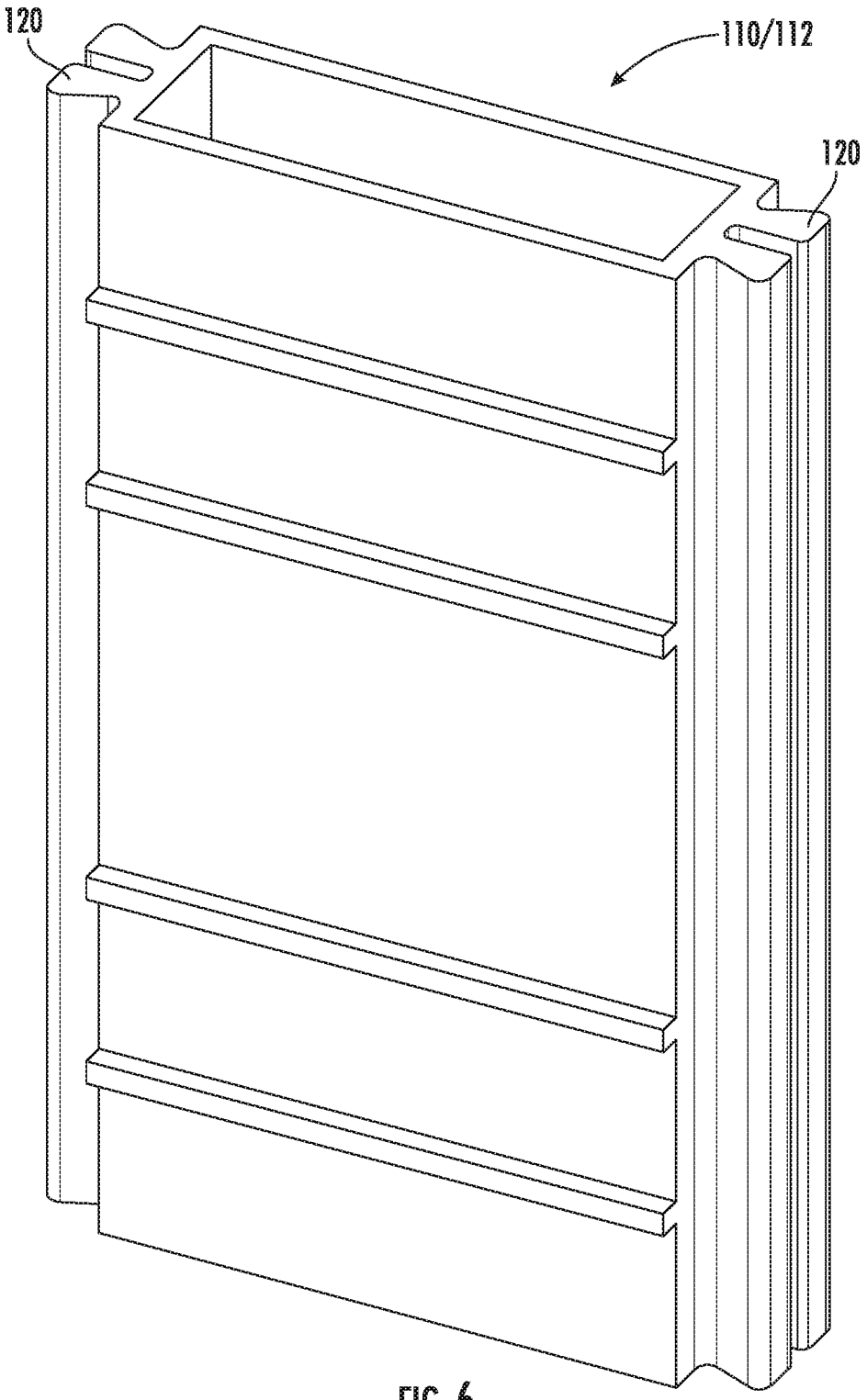
Figure 7:
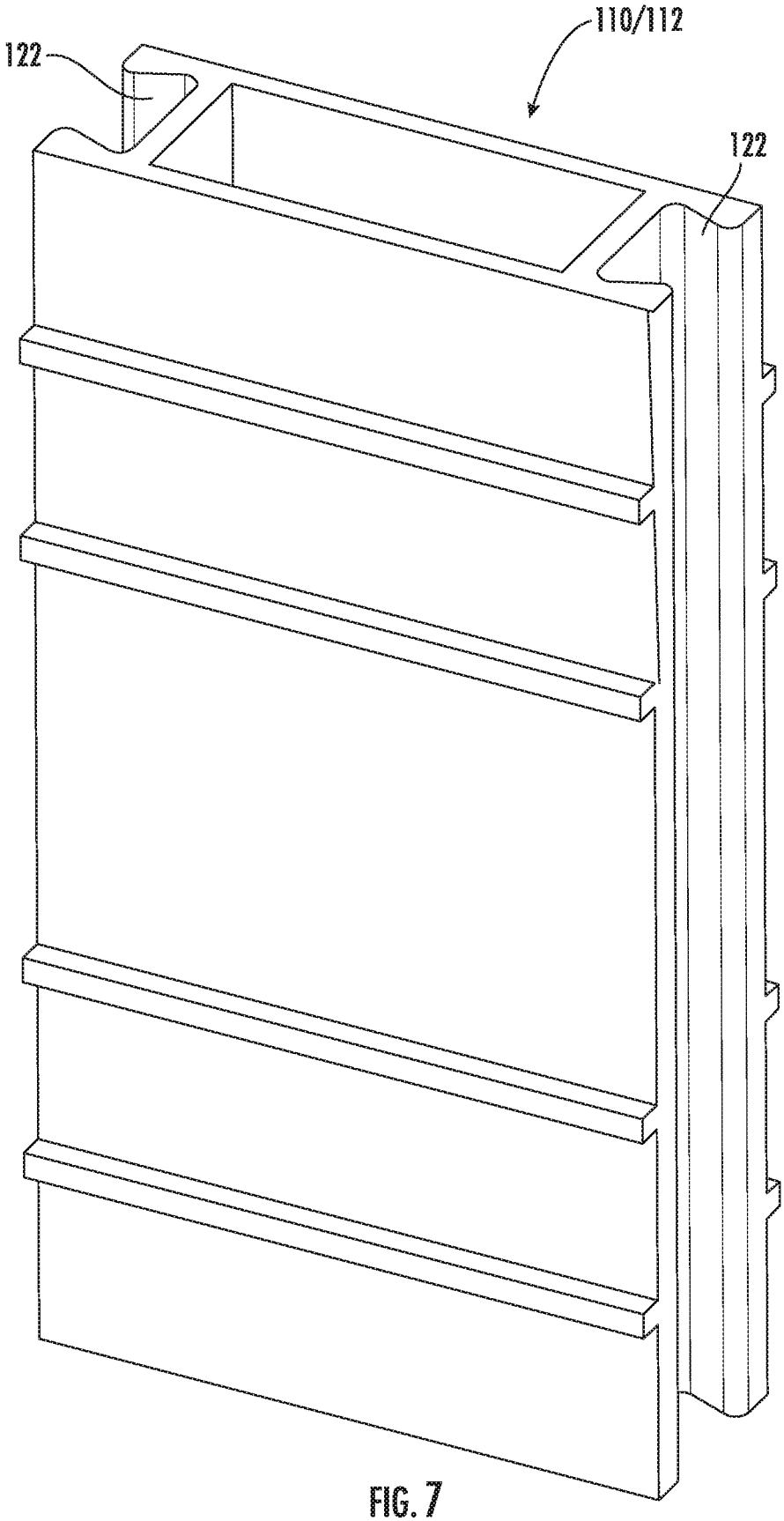
Figure 8:
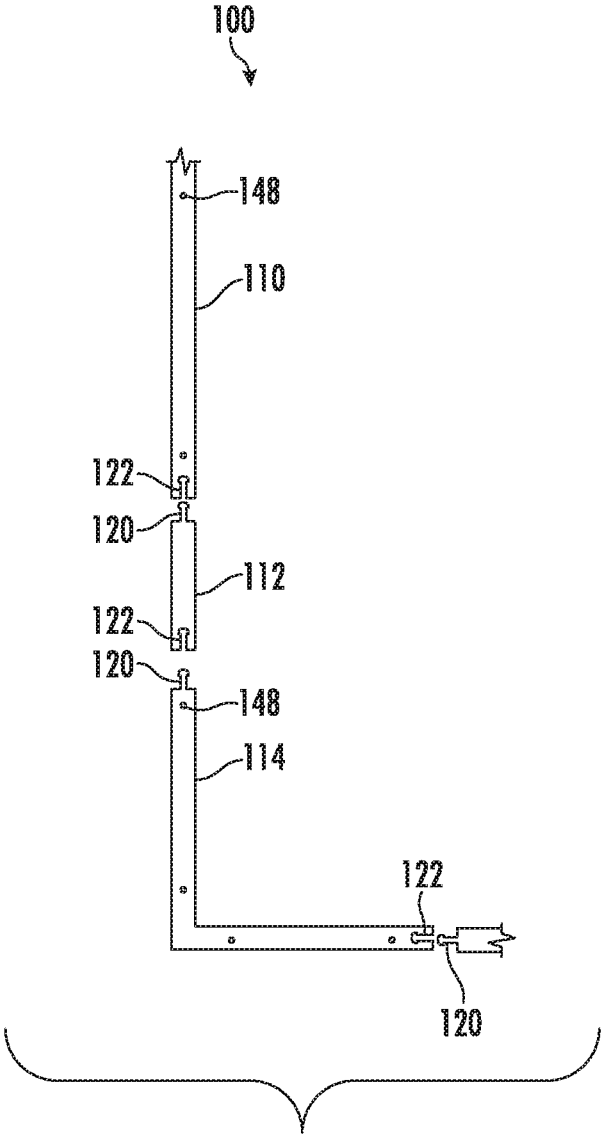
Figure 9:
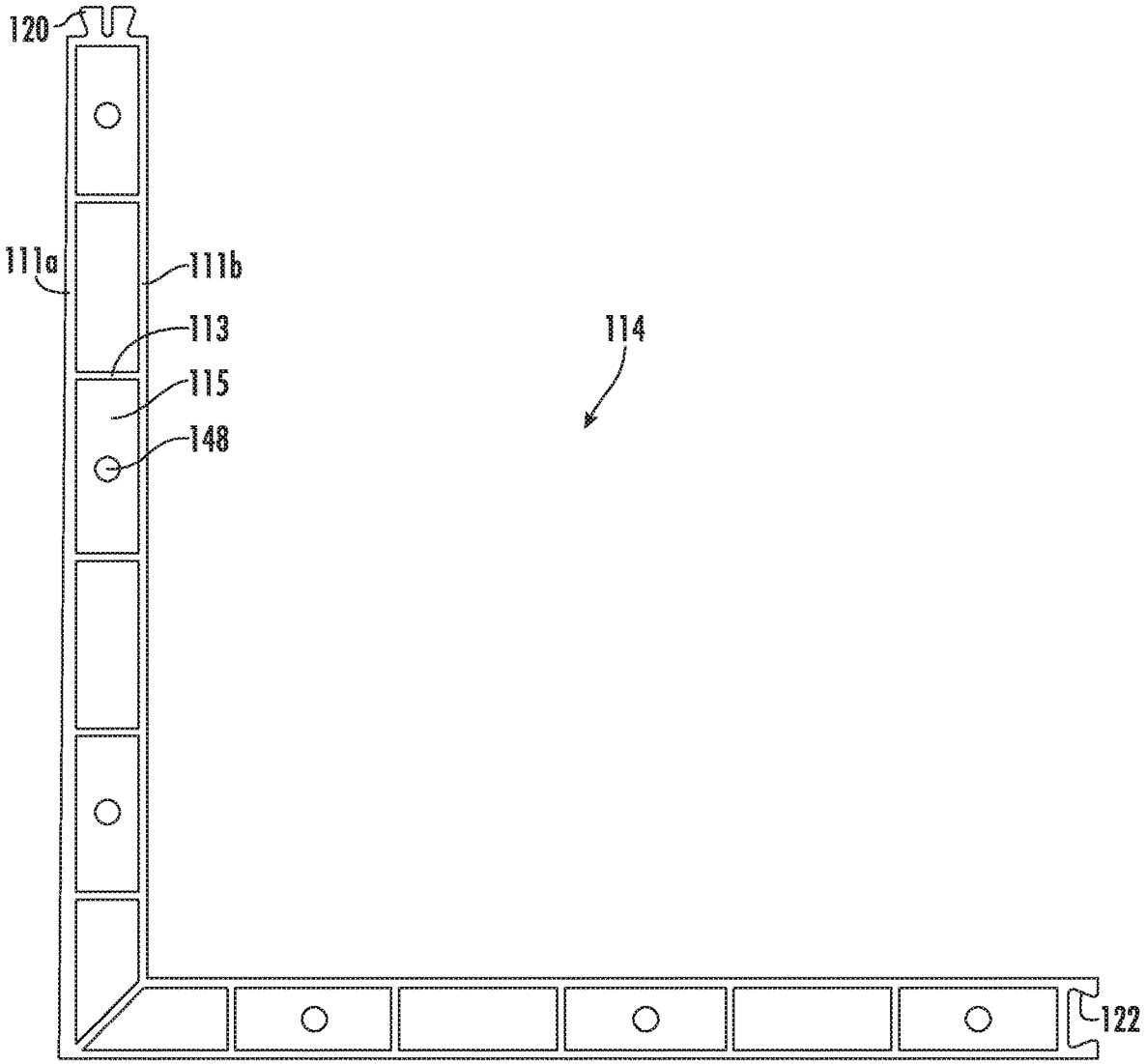
Figure 10:
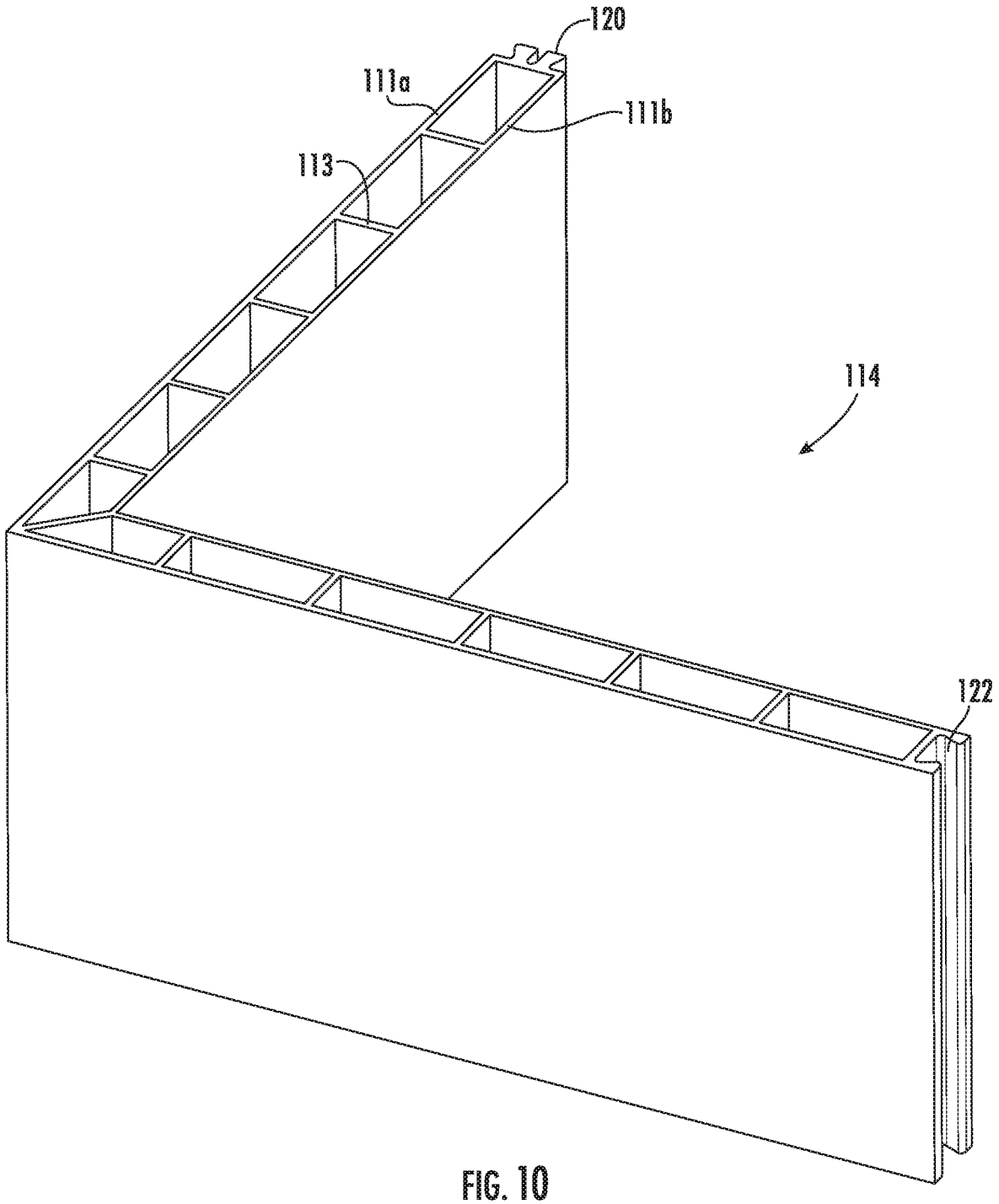
Figure 11:
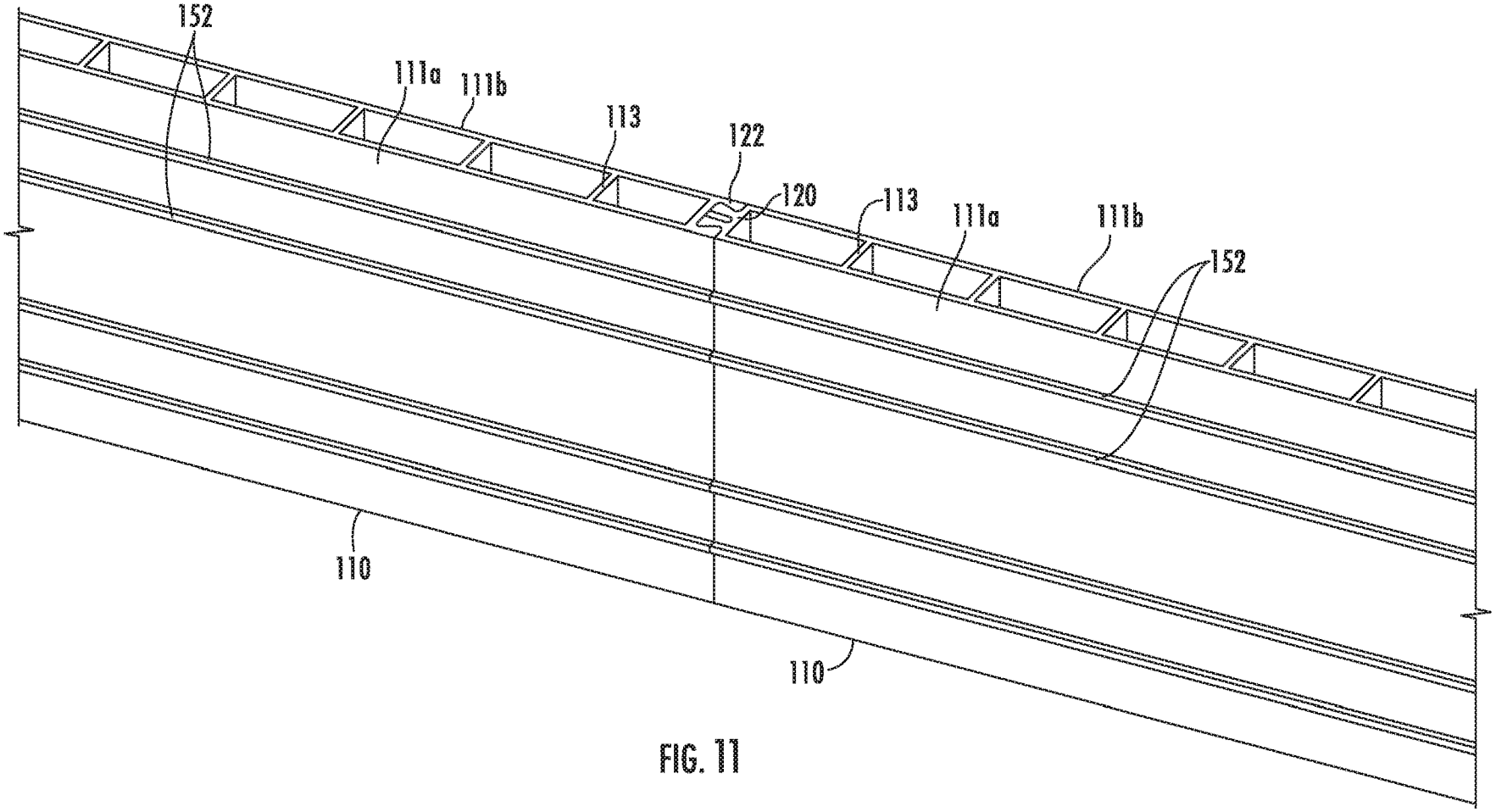
Figure 12:
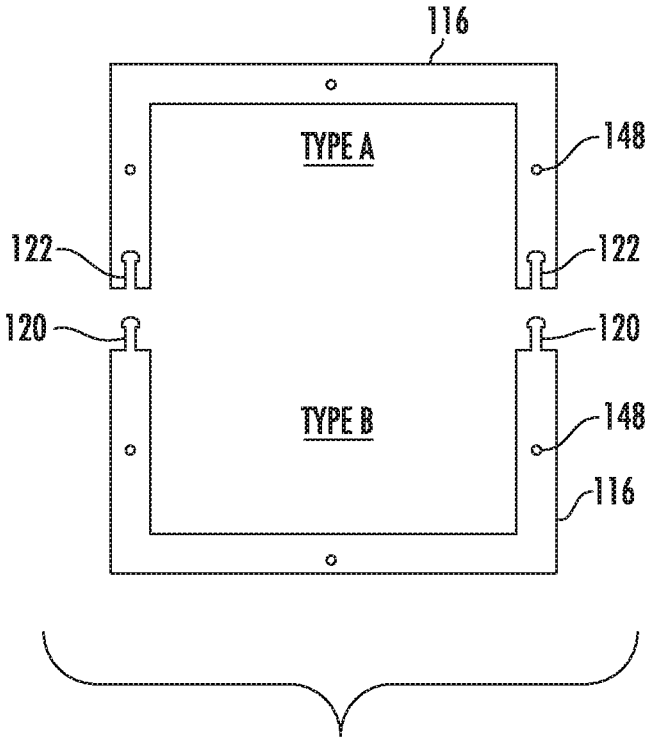
Figure 13:
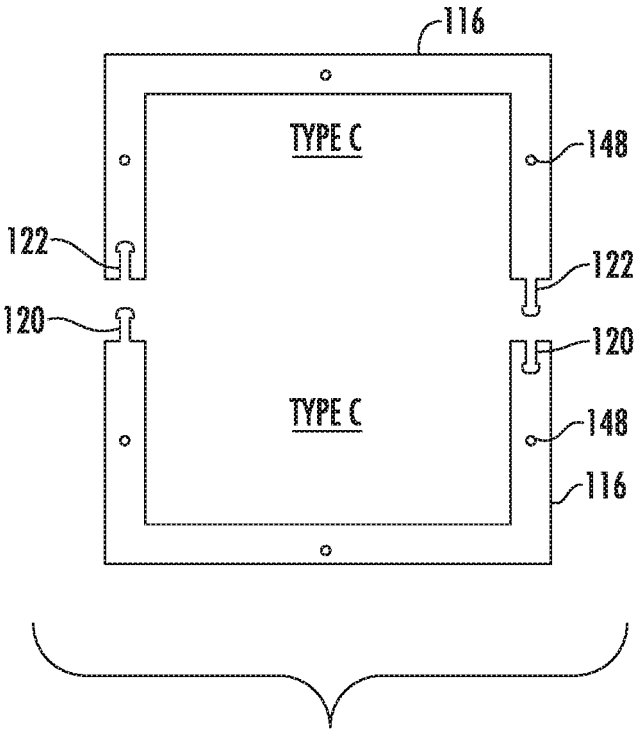
Figure 14:
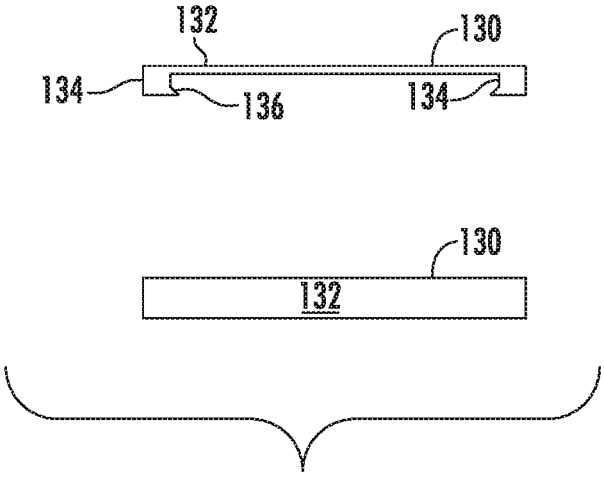
Figure 15:
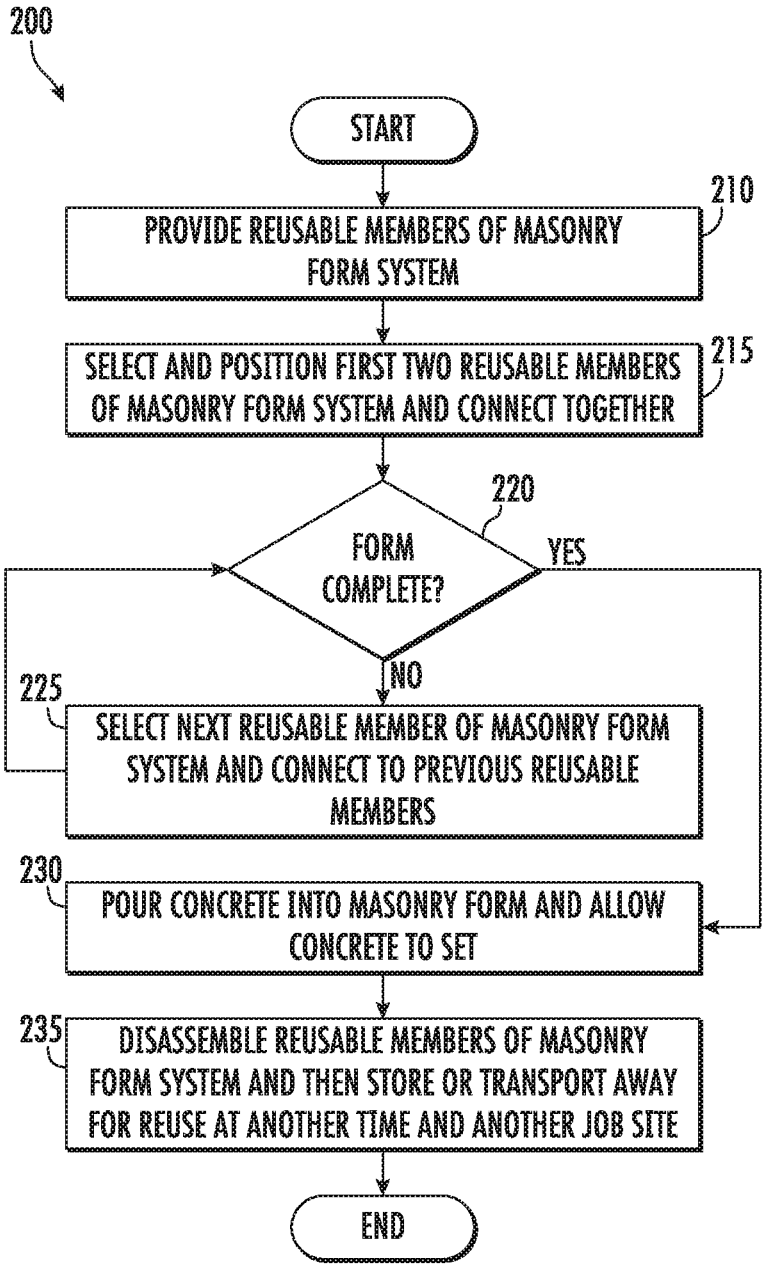

Having thus described the presently disclosed subject matter in general terms, reference will now be made to the accompanying Drawings, which are not necessarily drawn to scale, and wherein:

FIG. 1 illustrates a plan view of an example of the presently disclosed masonry form system comprising plastic reusable masonry form members;

FIG. 2 illustrates a side perspective view of a reusable straight member of the presently disclosed masonry form system;

FIG. 3 illustrates a cross-sectional view of the reusable straight member of FIG. 2;

FIG. 4 illustrates an end view, a side view, and a top view of an example of a reusable straight member of the presently disclosed masonry form system;

FIG. 5 illustrates a top view of an example reusable increment member of the presently disclosed masonry form system;

FIG. 6 illustrates a side perspective view of an example plastic reusable masonry form member having a connector tab at each end in accordance with an embodiment of the invention;

FIG. 7 illustrates a side perspective view of an example plastic reusable masonry form member having a connector slot at each end in accordance with an embodiment of the invention;

FIG. 8 illustrates a top view of an example of an arrangement of the reusable straight member, the reusable increment member, and a reusable corner member of the presently disclosed masonry form system;

FIG. 9 and FIG. 10 illustrate a top view and perspective view of examples of a reusable corner member of the presently disclosed masonry form system;

FIG. 11 illustrates a side perspective view of two adjacent reusable masonry form members connected end-to-end in accordance with an embodiment of the invention;

FIG. 12 and FIG. 13 illustrate top views of examples of reusable U-members of the presently disclosed masonry form system;

FIG. 14 illustrates a side view and a top view of an example reusable anti-spread clip of the presently disclosed masonry form system; and FIG. 15 illustrates a flow diagram of an example of a method of using the presently disclosed masonry form system.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter may provide a masonry form system and method including plastic reusable masonry form members. Examples of reusable masonry form members may include, but are not limited to, straight members, increment members (or spacers), corner members, U-shaped members, and anti-spread clips. Further, a method of using the masonry form system is provided.

Referring now to FIG. 1 is a plan view of an example of the presently disclosed masonry form system 100 which may include plastic reusable masonry form members. For example, masonry form system 100 may include any number and/or arrangement of a variety of reusable masonry form members. Examples of reusable masonry form members may include, but are not limited to, straight members 110, increment members 112, corner members 114, U-members 116, and anti-spread clips 130. In the example shown in FIG. 1, the arrangement of straight members 110, increment members 112, corner members 114, U-members 116, and anti-spread clips 130 may provide a masonry form for building footings in a residential or commercial application. Namely, FIG. 1 shows an outer rectangular-shaped form 140, an inner rectangular-shaped form 142, and two square-shaped lolly column forms 144. Concrete 150 may be poured in the area between outer rectangular-shaped form 140 and inner rectangular-shaped form 142. Also, concrete 150 m be poured in each of the two lolly column forms 144.

The reusable masonry form members, such as straight members 110, increment members 112, corner members 114, U-members 116, and anti-spread clips 130, may be polymer-based members that are durable, moisture resistant, washable, and lightweight. In one example, the reusable masonry form members may be formed of thermoplastic material. The thermoplastic masonry form members may be substantially hollow, and may include a gap of about two (2) inches between its opposing vertical walls 111*a* and 111*b*. With reference to FIGS. 2-3, the thermoplastic masonry form members may further include internal vertical ribs 113 sandwiched between opposing vertical walls 111*a* and 111*b* of the thermoplastic masonry form members to provide added strength and stability. In one example, internal vertical ribs 113 may be evenly spaced along a length of the thermoplastic masonry form member. Thermoplastic masonry form members may further include one or more internal horizontal ridges 115. In one example, an internal horizontal ridge 115 may run the length of the thermoplastic masonry form member at about its vertical midpoint. In one embodiment, thermoplastic masonry form members may be filled with foam to provide added strength and to provide capability to withstand a broader range of heat and cold. Additionally, the reusable masonry form members of masonry form system 100 may be used in place of conventional wood forms, yet the installation is similar to wood forms (a familiar process for installers).

FIG. 4 shows various views of an example of straight member 110, which may be a straight reusable masonry form member. In one example, straight member 110 may be about 2 inches thick, about 12 inches high, and any length, for example, from about 2 feet long to about 12 feet long. Increment member 112 is a type of straight member 110 albeit a short length straight member 110. Increment members 112 may be used in combination with straight members 110 to achieve any length required that conform to a typical form.

Referring still to FIG. 4, once the reusable masonry form members have been placed, they may be secured in place by driving rebar, or other suitable securing mechanism, vertically through one or more channels 148. The channels 148 may be formed as plastic through-holes; or alternatively may include a sleeve made of various materials, such as galvanized metal, stainless steel, or other suitably durable material. In one example, channels 148 may be space about every two (2) feet from one another along a length of the reusable masonry form member. Further, channels 148 may have a diameter sufficient for receiving a standard piece of rebar, for example, channels 148 may have a diameter the range of about ½ an inch to about ⅝ of an inch.

FIG. 5 shows various views of an example of the reusable increment member 112. In one example, increment member 112 may be about 2 inches thick, about 12 inches high, and available in various lengths, such as, but not limited to, 6 inches, 7 inches, 8 inches, and 9 inches long. Both straight member 110 and increment member 112 may have a connector tab 120 on one end and a connector slot 122 on the opposite end.

Alternatively, and with reference to FIGS. 6 and 7, one or more straight members 110 and increment members 112 may have connector tabs 120 on both ends (see FIG. 6), or may have connector slots 122 on both ends (see FIG. 7).

FIG. 8 illustrates a top view of an example of an arrangement of the reusable straight member 110, the reusable increment member 112, and a reusable corner member 114. With further reference to FIGS. 9 and 10, corner member 114 may be designed to provide a 90 degree corner member. In one non-limiting example, corner member 114 may be about 2 inches thick, about 12 inches high, and each side of corner member 114 may be, for example, about 26 inches long. Like straight member 110 and increment member 112, corner member 114 may have a connector tab 120 on one end and a connector slot 122 on the opposite end, or alternatively may have connector tabs 120 on both ends or connector slots 122 on both ends.

With reference to FIG. 11, connector tab 120 and connector slot 122 may be designed to be fitted together in a slideable fashion for connecting end-to-end any two adjacent form members. For example, and referring back to FIG. 8, the connector slot 122 of a straight member 110 may be engaged with the connector tab 120 of an increment member 112, then the connector slot 122 of the increment member 112 may be engaged with the connector tab 120 of a corner member 114, and then the connector slot 122 of the corner member 114 may be engaged with the connector tab 120 of the next member.

Connector tab 120 and connector slot 122 is just one example of how adjacent form members may be connected together. Any other suitable technique or mechanism for connecting adjacent form members may alternatively be used.

FIG. 12 and FIG. 13 illustrate top views of examples of the reusable U-members 116. U-members 116 are U-shaped masonry form members. In one non-limiting example, U-member 116 may be about 2 inches thick, about 12 inches high, about 28 inches wide, and about 14 inches deep. FIG. 12 shows two types of U-members 116. Namely, a Type A that has a connector slot 122 at both ends and a Type B that has a connector tab 120 at both ends. In this example, the connector tabs 120 of the Type B U-member 116 may engage with the connector slots 122 of the Type A U-member 116. Further, in this example, forming lolly column form 144 may require one Type A U-member 116 and one Type B U-member 116. By contrast, FIG. 13 shows a pair of Type C U-members 116. Namely, a Type C U-member 116 has a connector tab 120 at one end and a connector slot 122 at the opposite end. In this way, two Type C U-members 116 may be oppositely oriented and then engaged. In this example, lolly column form 144 may be formed using two of the same type of U-members 116; namely, two Type C U-members 116.

FIG. 14 shows various views of example reusable anti-spread clips 130. Anti-spread clip 130 may include a cross member 132 and two side members 134 (one on each end of cross member 132). Further, each of the side members 134 may have a lip 136. In one example, for a 24 inch wide footings, anti-spread clip 130 may have an overall length of about 33 inches, a width of about 3 inches, and an overall thickness of about 2 inches. In this example, the space between the two side members 134 may be, for example, about 29 inches, and the space between the tips of lips 136 may be, for example, about 28 inches. In another example, for 16 inch wide footings, anti-spread clip 130 may have an overall length of about 25 inches, a width of about 3 inches, and an overall thickness of about 2 inches. In this example, the space between the two side members 134 may be, for example, about 21 inches, and the space between the tips of lips 136 may be, for example, about 20 inches.

Anti-spread clip 130 is designed to span across, for example, a pair of straight members 110 as shown in FIG. 1. The two side members 134 and their lips 136 are designed to grip the straight members 110. Accordingly, in masonry form system 100, anti-spread clips 130 may be installed as needed to prevent other members from spreading once filled with concrete 150.

FIG. 15 illustrates a flow diagram of an example of a method 200 of using the presently disclosed masonry form system 100. Method 200 may include, but is not limited to, the following steps.

At a step 210, the reusable members of masonry form system 100 may be provided. For example, an assortment of straight members 110 of various lengths, an assortment of increment members 112 of various lengths, corner members 114, U-members 116, and anti-spread clips 130 may be provided at the job site.

At a step 215, the first two reusable members of masonry form system 100 may be selected (according to plan), positioned (according to plan), and then connected together. In one example, two straight members 110 may be selected, positioned, and then connected together using their respective connector tabs 120 and connector slots 122. In another example, a straight member 110 and an increment member 112 may be selected, positioned, and then connected together using their respective connector tabs 120 and connector slots 122. In yet another example, a straight member 110 and a corner member 114 may be selected, positioned, and then connected together using their respective connector tabs 120 and connector slots 122.

At a decision step 220, it is determined whether the masonry form is complete according to plan. If the masonry form is not complete, then method 200 may proceed to method step 225. However, if the masonry form is complete then method 200 may proceed to method step 230.

At a step 225, the next reusable member of masonry form system 100 may be selected (according to plan), positioned (according to plan), and then connected to one of the previously installed reusable members. For example, according to plan, a straight member 110 of a certain length, an increment member 112 of a certain length, a corner member 114, or a U-member 116 may be selected, positioned (according to plan), and then connected to one of the previously installed reusable members. In another example, one or more anti-spread clips 130 may be selected and installed. Method 200 may then return to decision step 220.

At a step 230, concrete 150 may be poured into the reusable masonry form built using masonry form system 100 and then allowed to set.

At a step 235, the reusable masonry form built using masonry form system 100 may be disassembled and then stored and/or transported away. For example, all of the used reusable members of masonry form system 100 (e.g., straight members 110, increment members 112, corner members 114, U-members 116, and anti-spread clips 130) may be disengaged from one another, cleaned of any excess concrete, and then stored and/or transported away for reuse at another time and/or another job site.

Referring again to FIG. 1 through FIG. 15, the presently disclosed masonry form system 100 and method 200 including plastic reusable masonry form members may be summarized as follows.

In masonry form system 100, the reusable masonry form members (e.g., straight members 110, increment members 112, corner members 114, and U-members 116) may be placed vertically as they measure 2 inches×12 inches and placed, pulling off of corners that have been staked by a surveyor, which would be based on blueprints for a particular house or building. The reusable masonry form members may be placed in a trench based on the building plan. The reusable masonry form members may be connected by sliding male ends (e.g., connector tabs 120) and into female ends (e.g., connector slots 122). Forms (e.g., straight members 110) may be provided, for example, at from about 2 feet to about 12 feet in length and spacers (e.g., increment members 112) may be provided to achieve any length required that conform to typical form.

Once the reusable masonry form members have been placed, they may be secured by driving rebar vertically through the channels 148 provided, which may be a formed plastic through-hole, or could alternatively be a galvanized metal or stainless steel sleeve. A string line or transit may be used to keep the alignment of the form straight and level using material such as slate or other shimming material. In one example, masons pins may be placed on the outside of the reusable masonry form members to prevent the weight of the concrete from pushing out the forms or spreading them.

At this point, if the building plan calls for horizontal and/or vertical rebar, the rebar may be placed inside the reusable masonry form members. The rebar usually sit on metal chairs, the number and size of such rebar would be specified in the building plans. After rebar is in place, it could be connected to the vertical rebar in the reusable masonry form members, which has been placed, for example, at about every 2 feet.

Once the masonry form is level, dimensions checked, and rebar installed, anti-spread clips 130 may optionally be installed with the masonry form. The anti-spread clips 130 may, for example, be about 24 inches long and may snap onto the vertical form members to prevent the concrete from pushing out the form members. The anti-spread clips 130 may be installed as needed, usually about 4 feet on center. 16-inch anti-spread clips 130 may be provided for smaller footings. Once the concrete has been poured and starts to set, the anti-spread clips 130 may be removed, cleaned of any excess concrete, and reused.

After pour, e.g., one day after pour, the reusable masonry form members (e.g., straight members 110, increment members 112, corner members 114, and U-members 116) may be removed while trying not to damage them, although they are formed of durable, moisture resistant material that can stand reuse. A benefit of the presently disclosed masonry form system 100 including plastic reusable masonry form members is that it is lighter than wood or steel, easier to remove and clean than wood or steel, and because it can be used again and again it saves natural resources.

The reusable masonry form members may further be foam filled to provide added structural strength. In one example, the reusable masonry form members may be filled with a foam, for example, Polycel Structural Foam, or other suitable foam filler.

The reusable masonry form members may have one or more horizontal ribs 152 along their exterior walls that may be, for example, 8 inches and/or 10 inches high based on the required footing depth. The one or more horizontal ribs 152 may extend about a 0.5 inch out from the exterior surface of the reusable masonry form members to allow for a trowel to be run along it to ensure a level footing.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A method of using a masonry form system, the method comprising:

a. providing a masonry form system, comprising:

i. a plurality of masonry form members, wherein the plurality of masonry form members comprise:

opposing side walls;

one or more longitudinally extending ribs formed between the opposing side walls, the one or more ribs forming a gap between the opposing side walls;

a connector mechanism formed on each of a first end and a second end of each of the plurality of masonry form members, wherein the connector mechanism comprises one of a connector tab extending outward from its associated first and/or second end and extending along a length thereof or a connector slot formed as a channel extending along a length of its associated first and/or second end; and one or more ribs formed on an outer surface of one or both of the opposing side walls and extending between the first end and the second end, the one or more ribs being disposed in-between and substantially parallel with an upper and bottom most edge of the plurality of masonry form members; and wherein, the plurality of masonry form members are configured to be connected together via the connector mechanisms, wherein the connector tab of one of the plurality of masonry form members is configured to be received by a corresponding connector slot of an adjacent one of the plurality of masonry form members thereby locking the two masonry form members together;

b. selecting a determined number of the plurality of masonry form members based on a pre-determined plan to form a desired masonry form;

c. positioning the selected plurality of masonry form members based on the pre-determined plan to form the desired masonry form; and d. connecting the selected and positioned plurality of masonry form members together.

2. The method of claim 1 further comprising pouring concrete into the formed masonry form.

3. The method of claim 1 further comprising securing one or more of the plurality of masonry form members in place via driving rebar vertically through one or more vertical channels formed in the one or more of the plurality of masonry form members, and into a ground surface.

4. The method of claim 1 further comprising installing one or more anti-spread clips across a top portion of two opposing masonry form members spaced laterally apart from one another.

5. The method of claim 1 further comprising disassembling the connected plurality of masonry form members.

6. A masonry form system, comprising:

a. a plurality of masonry form members, wherein the plurality of masonry form members comprise:

i. opposing side walls;

ii. one or more longitudinally extending ribs formed between the opposing side walls, the one or more ribs forming a gap between the opposing side walls;

iii. a connector mechanism formed on each of a first end and a second end of each of the plurality of masonry form members, wherein the connector mechanism comprises one of a connector tab extending outward from its associated first and/or second end and extending along a length thereof or a connector slot formed as a channel extending along a length of its associated first and/or second end; and iv. one or more ribs formed on an outer surface of one or both of the opposing side walls and extending between the first end and the second end, the one or more ribs being disposed in-between and substantially parallel with an upper and bottom most edge of the plurality of masonry form members; and wherein, the plurality of masonry form members are configured to be connected together via the connector mechanisms, wherein the connector tab of one of the plurality of masonry form members is configured to be received by a corresponding connector slot of an adjacent one of the plurality of masonry form members thereby locking the two masonry form members together.

7. The system of claim 6 further comprising one or more anti-spread clips, wherein the anti-spread clips are configured to engage a pair of opposing masonry form members laterally spaced apart from one another, and wherein the anti-spread clip is configured to span from the upper edge portion of a first side wall of a first masonry form member to the upper edge portion of a second side wall of a second masonry form member.

8. The system of claim 7 wherein the one or more anti-spread clips comprise:

a. a cross member, wherein the cross member is substantially straight along its length;

b. side members, one extending perpendicularly downward from each end of the cross member; and c. a lip, one extending inward from each of the side members, wherein the lip is substantially parallel with the cross member.

9. The system of claim 6 wherein the plurality of masonry form members comprise one or more of any of a straight member, a spacer member, a corner member, and/or a U-shaped member.

10. The system of claim 6 wherein the plurality of masonry form members are configurable to provide a masonry form for building footings in a residential or commercial application.

11. The system of claim 10 wherein the plurality of masonry form members are configurable to form a first outer perimeter structure and a second inner perimeter structure, wherein the first outer perimeter structure and the second inner perimeter structure are spaced apart and configured to receive concrete to form footings.

12. The system of claim 6 wherein the plurality of masonry form members comprise thermoplastic material.

13. The system of claim 6 wherein the plurality of masonry form members are at least partially hollow between the opposing side walls.

14. The system of claim 6 wherein one or more of the plurality of masonry form members are at least partially filled with a structural foam between the opposing side walls.

15. The system of claim 6 wherein the plurality of masonry form members comprise one or more longitudinal ribs formed between the opposing side walls.

16. The system of claim 6 wherein the plurality of masonry form members comprise one or more latitudinally extending ribs formed between the opposing vertical side walls.

17. The system of claim 6 wherein the plurality of masonry form members comprise one or more longitudinal ribs and one or more latitudinally extending ribs formed between the opposing vertical side walls.

18. The system of claim 6 wherein the plurality of masonry form members comprise one or more channels extending longitudinally through one or more of the plurality of masonry form members.

19. The system of claim 6 wherein the connector tab of a first masonry form member is configured to slideable engage with the connector slot of an adjacent second masonry form member.

20. The system of claim 6 wherein one or more of the plurality of masonry form members comprise the connector tab on one end and the connector slot on an opposing end.

21. The system of claim 6 wherein one or more of the plurality of masonry form members each comprise a connector tab on both ends or a connector slot on both ends.

22. The system of claim 9 wherein the corner member is configured to form a substantially 90 degree corner.

* * * * *